US012606338B2

(12) United States Patent
Buehne et al.

(10) Patent No.: US 12,606,338 B2
(45) Date of Patent: Apr. 21, 2026

(54) STRAPPING APPARATUS AND METHOD OF HANDLING STRAPPING

(71) Applicants: Lukas Buehne, Schwelm (DE); Christian Noelke, Duesseldorf (DE); Bastian Protzmann, Wuppertal (DE)

(72) Inventors: Lukas Buehne, Schwelm (DE); Christian Noelke, Duesseldorf (DE); Bastian Protzmann, Wuppertal (DE)

(73) Assignee: TITAN UMREIFUNGSTECHNIK GMBH & CO. KG, Schwelm (DE)

( * ) Notice: Subject to any disclaimer, the term of this patent is extended or adjusted under 35 U.S.C. 154(b) by 159 days.

(21) Appl. No.: 18/528,078

(22) Filed: Dec. 4, 2023

(65) Prior Publication Data

US 2024/0182199 A1 Jun. 6, 2024

(51) Int. Cl.
*B65B 69/00* (2006.01)

(52) U.S. Cl.
CPC ..... *B65B 69/0025* (2013.01)

(58) Field of Classification Search
CPC ..... B65B 69/0025
See application file for complete search history.

(56) References Cited

U.S. PATENT DOCUMENTS 4,841,619 A * 6/1989 Theriault ..... B23D 23/00 29/426.3
5,156,516 A * 10/1992 Boisseau ..... B65B 69/0025 414/412
5,318,399 A * 6/1994 Marom ..... B65B 69/0025 414/412
5,970,834 A * 10/1999 Garofano ..... B65B 43/145 414/907
6,047,458 A 4/2000 Merrill
6,912,762 B2 * 7/2005 Lile ..... B65B 69/0025 29/709
8,365,389 B2 * 2/2013 Taylor ..... B65G 47/90 83/909
9,079,680 B2 * 7/2015 Vannice ..... B65B 69/0025
12,030,687 B2 * 7/2024 Königshofer ..... B65B 69/0025
12,227,328 B2 * 2/2025 Song ..... B65B 69/0025
2007/0044603 A1 * 3/2007 Scholtes ..... B65B 69/0025 83/72
2015/0000491 A1 * 1/2015 Figiel ..... B65B 69/0025 83/385
2020/0338776 A1 * 10/2020 Williamson ..... B26D 1/035
2023/0150707 A1 * 5/2023 Fusy ..... B65B 43/145 700/259

FOREIGN PATENT DOCUMENTS

WO 2019238856 A 6/2018

* cited by examiner

*Primary Examiner* — Omar Flores Sanchez
(74) *Attorney, Agent, or Firm* — Andrew Wilford

(57) ABSTRACT

A strapping apparatus for cutting a strap on a package has a treatment head having on a lower side a full base plate having a lift edge on a full base plate. A manipulator carries the treatment head for movement in three dimensions. A controller operates the manipulating means for first passing a corner of the base plate under the strap and subsequently pivoting in the base plate to completely underlie the strap.

10 Claims, 6 Drawing Sheets

STRAPPING APPARATUS AND METHOD OF HANDLING STRAPPING

FIELD OF THE INVENTION

The present invention relates to strapping a package with bands. More particularly this invention concerns an apparatus and method for cutting the bands off a package.

BACKGROUND OF THE INVENTION

The invention relates to a strapping apparatus, in particular a cutter for strapping bands, having a treatment head and a manipulator carrying the treatment head and moving the treatment head according to commands stored in a controller. The invention also relates to a method for treating and in particular cutting strapping.

Strapping apparatuses are basically used to handle so-called straps or strapping bands. The straps can be such made of plastic or also steel and serve to package goods. The packaged goods it can be paper or any material, pallets, and also steel coils.

Here there is the general problem that for further processing of the pack good the individual straps must be detached. This can be done completely in principle and manually by cutting shears. However such procedure is not only time-consuming but also dangerous because the straps concerned are typically under high tension and detach from the packaged goods after being cut like a whip. As a result, injuries to an operator are possible.

For this reason the prior art of technology, for example according to the WO 2019/238586 of applicant describes a cutter for strapping. This has a movable pressing element and a foot with a lift edge for gripping the strap between the foot and the pressing element. A cutting blade serves for cutting the gripped strapping. This has proven itself in principle.

In order to move the treatment head in question between the strap and the packaged goods, typically according to the generic state of the art corresponding to US 2007/0044603, a manipulator in form of a robot is used. The treatment head is connected to an arm and can be basically moved thereby in three dimensions. This allows the treatment head to be pushed under the strap and the strap then cut.

In the known teaching according to US 2007/0044603 for this purpose the procedure is such that the treatment head is equipped with two feet and a cutting apparatus between them. The feet clamp the strap is then sever it with the cutting apparatus. This requires that the feet be pushed under the strap.

This procedure cannot often be used in practice because the feet are relatively rugged and thick. Moving under the strap requires sufficient clearance between the package and the strap to be cut, so that the feet can move into the desired position and can grip the strap for cutting. Such free space is not available for all packages for example if materials like pallets or other packaged goods with totally closed or predominantly closed surfaces are strapped.

In addition to similar problems, there is the further predominantly generic prior art of technology according to U.S. Pat. No. 6,047,458. This describes a rotatable apparatus and a method for removing wires from a bale. For this purpose there is inter alia a rotary conveyor that turns the bale. This allows teeth of a separating blade to come into contact with the wires wrapped around the bale and to cut them. Here, at this point an additional manipulation of the packaged goods is absolutely necessary in order to be able to sever the wires. Such manipulation can typically only be realized with great effort and makes a cost-effective and marketable solution impossible. Here the invention aims to provide an overall remedy.

OBJECTS OF THE INVENTION

It is therefore an object of the present invention to further develop such a strapping apparatus and in particular cutting apparatus for strapping such that a perfect severing of the strap is also possible with little effort even when the strap lies closely and without spacing on the surface of the package. Also a corresponding and generic method for treatment and in particular for cutting a strap in a comparable manner and way is to be further developed.

SUMMARY OF THE INVENTION

This object is attained in that a prior-art strapping apparatus and in particular a cutter for straps within the framework of the invention is further characterized in that the treatment head has on a lower side of its arm a full base plate for initially engaging a corner underneath and subsequent pivoting in of the base plate to lie completely under the strap.

Thus, in accordance with the invention, the treatment head in a first step first of all engages with its foot-side beveled edge of the full base plate under the relevant strapping with a corner side. Such use at a corner of the foot-side lift edge of the full base plate is successful even if the strap lies closely against the package surface. This is because the base plate is advantageously beveled at the lift edge facing the strap.

The lift edge ensures that the base plate can be pushed first on the corner and then with its entire edge facing the strap under the strap. For this purpose, the push edge is formed at least partially with a bevel on the edge facing the strap. The bevel is designed such that the edge or corner of the base plate can be pushed by the treatment head in the pushing direction so its rising edge or growing slope raises the strap. In any case the treatment head can be pushed down at the corner as it were under the strap to be treated to and in particular to be cut, whereby the lift edge or its beveling enables it to be driven underneath.

Since at this point the treatment head with its base plate passes only at the corner first under the strap like a flat blade, any movements of the strap out of the way are not possible. Subsequently and in a second step, the treatment head with its full base plate passes under the strap completely. For this purpose the treatment head with the base plate is pivoted toward the strap. This is done by a wiping movement or pivotal movement of the base plate with its edge facing the strap as well as the lift edge or bevel provided here around a center in the area of the corner. This wiping movement or thrust movement is continued until the base plate has moved completely under the strap. This takes place with an alignment of the edge of the base plate facing the strap with the beveled lift edge such that the edge in question and the strap are mainly parallel to each other. Now the strap can be handled and in particular can be cut.

In this context it has further proved to be favorable, if the treatment head has, in addition to the base plate, at least a driven transport wheel and a cutting blade for cutting the gripped strapping. The transport wheel can remove the part of the strap from the treatment head and transport it away from the cutting blade. The cutting of the strap takes place while it is gripped. For this purpose the treatment head typically has a clamping ram that grips the strap. Subsequently the cutting blade ensures that the strap is cut.

For this purpose the cutting blade in general is associated with a counter cutting edge in the base plate. Here the cutting blade operates in the rule such that it cuts through the relevant strap in a plane perpendicular to the strap. In this context the counter cutting edge in the base plate ensures that during this process the cutting blade is not damaged or strikes the base plate.

In addition, the treatment head is usually still equipped with at least one sensor for detecting the strap on the packaged goods. The sensor can thereby advantageously be an optical sensor and for example a laser. In addition, the sensor is regularly connected to the controller. This enables the controller to align the cutting blade in the treatment head perpendicularly to the longitudinal extension of the strap in accordance with signals from the sensor.

The cutting blade does not only move during its cutting process perpendicular to the plane spanned by the strap similar to a guillotine. Rather, according to the invention and of particular importance is that the cutting blade has its lower cutting edge aligned perpendicular to the longitudinal extension of the strap, i.e. transversely. As a result, cutting of the strap takes place normally at a right angle. This is in particular important for the subsequent conveying of the severed part of the strap away from the treatment head with the aid of the transport wheel. This is because otherwise any problems during strap movement and for example the later transfer to a separate shredder or chopper can occur here with an angled end of the severed piece, because a strap with a nonperpendicular end edge skews the transport of the severed part of the strap in its guide groove can lead to blockages of the treatment head in this area.

The sensor and in particular the optical sensor of the strap on the packaged goods detects the strap or its absence. In addition, a further sensor can be implemented to detect the actual strap position or length of the strap. For this purpose, a distance measurement is usually carried out with the aid of laser sensors. As part of this distance measurement, the longitudinal length of the strap around the package can be detected because the additional material thickness of the strap leads to different distances compared to the package. In the course of measuring the strap position, the processing head with the relevant sensor may move once or several times across the strap and the packaged goods.

As a result, the controller is dependent on the signals from the optical sensor to be able to align the treatment head such that the cutting blade in the treatment head has its cutting edge perpendicular to the longitudinal extension or transversely of the strap is aligned. Then the strap is gripped by the clamping ram and cut or severed by the cutting blade. After retraction of the clamping ram, the severed part of the strap can be conveyed out of the treatment head by the driven conveyor belt. The severed part of the strap can then finally be clamped by the manipulator as well as if necessary then fed to a standard strap shredder or to the previously already mentioned chopper. This allows the separated part of the strap not only to be handled particularly well, but in principle also makes for example recycling possible, if the strap is of plastic or steel. Instead of having to handle the strap, consequently according to the invention only bits of the shredded and removed strap and have to be dealt with.

According to a further advantageous embodiment the manipulator is generally a robot. This robot has at least one arm carrying the treatment head. In addition as a rule also still a base supports the arm.

The result is a strapping and in particular cutting apparatus for straps as well as an associated method for treatment and in particular cutting of a strap, which operate practically fully automatically up to shredding the strap. Of particular importance is in this context that the strap can also then be cut while on the packaged goods, even if it is tightly bound around the packaged goods. In this regard in contrast to the prior art the strapping apparatus according to the invention and the method described do not require a cavity, in order to be able to attach and operate the treatment head for cutting the strap. These are the essential advantages.

BRIEF DESCRIPTION OF THE DRAWING

The invention is described below in more detail with reference to a drawing showing a single embodiment. In the drawing.

SPECIFIC DESCRIPTION OF THE INVENTION

Figure 1:
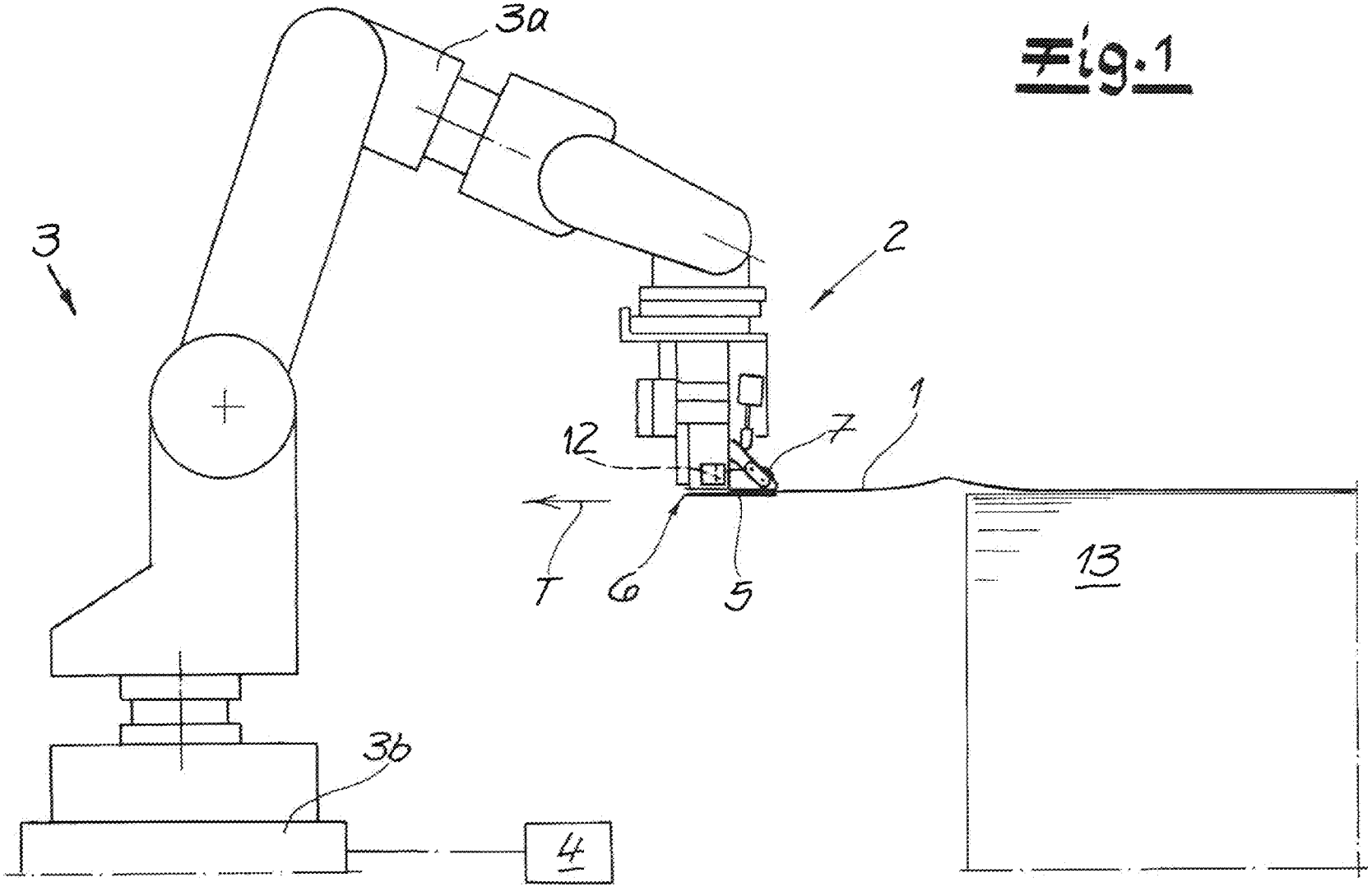
FIG. 1 is a schematic view of the strapping apparatus.

The drawing shows a strapping apparatus and specifically a cutter for a strap 1. The strapping apparatus or cutter is essentially designed in two parts, namely a treatment head 2 and a manipulator 3 carrying the treatment head 2. The manipulator 3 according to this embodiment is a robot 3. The robot 3 is in turn equipped with at least an arm 3*a* and a base 3*b* supporting the arm 3*a*. The base 3*b* can be stationary or movable. For this purpose, the base 3*b* may be rotatable and can move for example on rails.

The treatment head 2 is here moved with the aid of the manipulator or robot 3 and in accordance with commands stored in a controller 4. For this purpose the controller 4 is connected to various actuators of the manipulator or robot 3. In addition, the treatment head 2 is controlled by the controller 4.

It is of particular inventive importance that the treatment head 2 has a beveled lift edge 6 on a full base plate 5. The base plate 5 is thereby largely rectangular. Furthermore the lift edge 6 is formed at a front edge 5*a* of the rectangular base plate 5 on its side turned toward the strap 1. Opposite this front edge 5*a* of the base plate 5 facing the strap 1 is a back edge 5*b* shown in the drawing. The two edges 5*a* and 5*b* of the base plate 5 extend longitudinally.

The bevel 6 of the base plate 5 is formed at the edge 5*a* turned toward the strap 1 according to this embodiment with a bevel. In fact the beveled lift edge 6 is designed in such a way that it can slide under the strap 1 as shown in the sequence of FIGS. 3A to 3D in detail and as described in more detail below, the beveled edge in question 6 being aligned as shown in FIGS. 3A to 3D that a pushing movement S of the treatment head 2 causes the beveled edge 6 with its rising flank to engage under the strap 1 as described in more detail below. Here the flank in question of the beveled edge 6 and a base surface of the base plate 5 according to this embodiment form an angle $\alpha$ for the bevel of approximately 20° to 40° and here approximately 30°. This applies understandably only by way of example.

Figure 2:
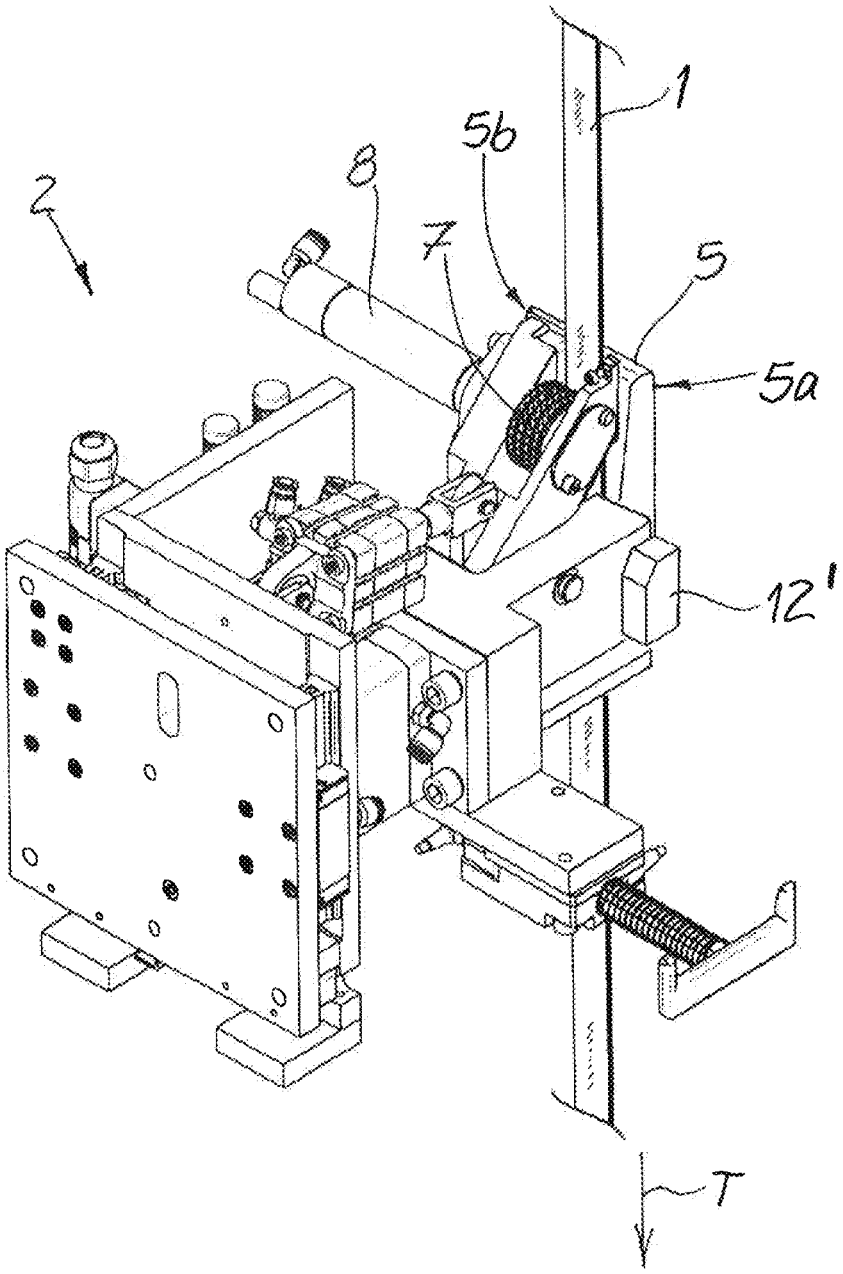
FIG. 2 is a perspective view of the strapping head.

FIG. 2 shows that the treatment head 2 has, in addition to the already described base plate 5 at least one driven transport wheel 7. The drive 8 for the transport wheel 7 at this location can according to this embodiment be a compressed-air motor understandably only by way of example. In addition there is a cutting blade 9 that serves to sever the clamped strapping strap 1. The cutting process takes place such that the cutting blade 9 moves with its front cutting edge 9*a* perpendicular to a plane of the strap 1 and consequently also perpendicular to the plane of the base plate 5. Thus during this process the base plate 5 is not damaged since the cutting blade 9 works with a counter blade 10 carried on the plate 5 (see FIG. 3D).

In addition a clamping ram 11 carried on the treatment head 2 can grip the strap 1. Finally the treatment head 2 is equipped with at least one sensor 12 for strap detection. The sensor 12 determines whether or not the strap 1 is there. In addition and as a supplement, a further sensor 12', which can only be seen in detail in FIG. 2, may be provided that can detect the position of the strap 1 in FIG. 3A to 3D on the packaged goods 13. FIGS. 3B and 3C show both sensors 12 and 12' only shown schematically with regard to their position in or on the treatment head 2.

The sensor 12 or 12' is according to this embodiment an optical sensor, for example a laser. The sensor 12 or 12' is, like the entire treatment head 2, thus in particular also the drive 8, connected to the controller 4. This enables the controller 4 to align the cutting blade 9 and in particular its front cutting edge 9*a* in the treatment head 2 in such a way in accordance with signals from the sensor 12, 12' that the cutting edge 9*a* is perpendicular to the longitudinal extension of the strap 1 as shown in detail in the enlarged view of FIG. 3D. Such perpendicular orientation of the cutting edge 9*a* and thus also of the cutting blade 9 resulting therefrom ensures that the severing effected by the cutting blade 9 is failure proof so that the cut end of the strap 1 can be moved without any problems by the transport wheel 7 for example after the severing process executed by the treatment head 2, and namely without any jamming or blockages in the interior of the treatment head 2.

For this purpose the design is such that the sensor 12 or 12' scans the packaged goods 13 including the strap 1 thereon, as the sensors 12 and 12' are moved along the surface of the packaged goods 13 and thereby passes over the strap 1 to be severed. Back and forth movement of the treatment head 2 with the sensors 12 and 12', which is easily controlled by the controller 4 with the aid of the manipulator or robot 3, makes it possible to easily determine the presence and exact longitudinal orientation of the strap 1 on the packaged goods 13. This is subsequently of importance, when the treatment head 2 with its base plate 5 passes under the strap 1 and the strap 1 is finally cut by the cutting blade 9. This is so since the cutting blade 9 is aligned with its front cutting edge 9*a* perpendicular to the longitudinal extension of the strap 1, as shown in the enlarged view FIG. 3D.

Thus, with the aid of the sensor 12' the strap position of the strap 1 on the packaged goods 13 is detected and the sensor 12 is for generally detecting the strap 1. Then the treatment head 2 is aligned with its cutting blade 9 perpendicular to the longitudinal extension of the strap 1. The strap 1 is then gripped by the clamp ram 11 and finally is cut by the cutting blade 9.

After retraction of the clamp ram 11 the strap 1 or the detached part of the strap 1 is moved by the transport wheel 7 rotated by the drive 8. The separated part of the strap 1 is displaced from the treatment head 2 with the aid of the transport wheel 7 moved by the drive 8, and indeed in the transport direction T shown in FIG. 1. The severed strap is consequently conveyed away from the treatment head 2 and out of the output side of the treatment head 2 by a gripper that is not explicitly shown as a part of the manipulator or robot 3 but that is illustrated and described in EP 4,382,438. This enables the manipulator or robot 3 to feed the severed strap 1 to an also not illustrated strap shredder. This strap shredder comminutes the strap 1. The workpiece here is for example a plastic or steel strap, so the shredded bits ejected from the output side of the strip shredder can be recycled as described above.

Scanning of the strap position of the strap 1 with the aid of the sensor or optical sensor 12' is carried out such that the laser or the optical sensor 12' here is moved over the packaged goods 13 and detects the strap on the packaged goods 13. Since the strap 1 has a certain material thickness, the position of the strap 1 and its longitudinal extension can be deduced from distance measurements in comparison to the packaged goods 13 using the sensor 12' to determine the position of the band.

Of decisive inventive importance to the process shown in FIGS. 3A to 3D in detail is how the strap 1 is lifted by the base plate 5 on the treatment head 2 before the cutting process of the strap 1, as previously described in detail. In fact this process of passing under is revealed by a sequence of individual functional positions shown in FIGS. 3A to 3D. Previously or simultaneously here first the position of the strap 1 on the packaged goods 13 or the general presence of the strap 1 is determined by the sensor 12 and then the exact position of the strap 1 by the sensor 12'.

In fact passing under the strap 1 according to the invention is effected such that the treatment head 2 with the foot-side lift edge 6 of its full base plate 5 initially pushes down under the relevant strapping strap 1 at a corner like a flat sharp axe. This is shown by the sequence of the FIGS. 3A and 3B. Here one can see how the treatment head 2 with its one corner approaches the strap 1.

In fact the corner in question is the corner of the treatment head 2 formed on the front edge 5*a* of the base plate 5 with the beveled edge 6 turned toward the strap 1. In addition one can see that the corner adjacent the sensor or optical sensor 12 is positioned such that the optical sensor 12 can monitor the subsequent process of pivoting as shown in FIGS. 3C and 3D while at the same time ensuring that in the pivoted-in position the cutting edge 9*a* and thus also the cutting blade 9 are both oriented perpendicular to the longitudinal extension of the strap 1.

Figure 3A:
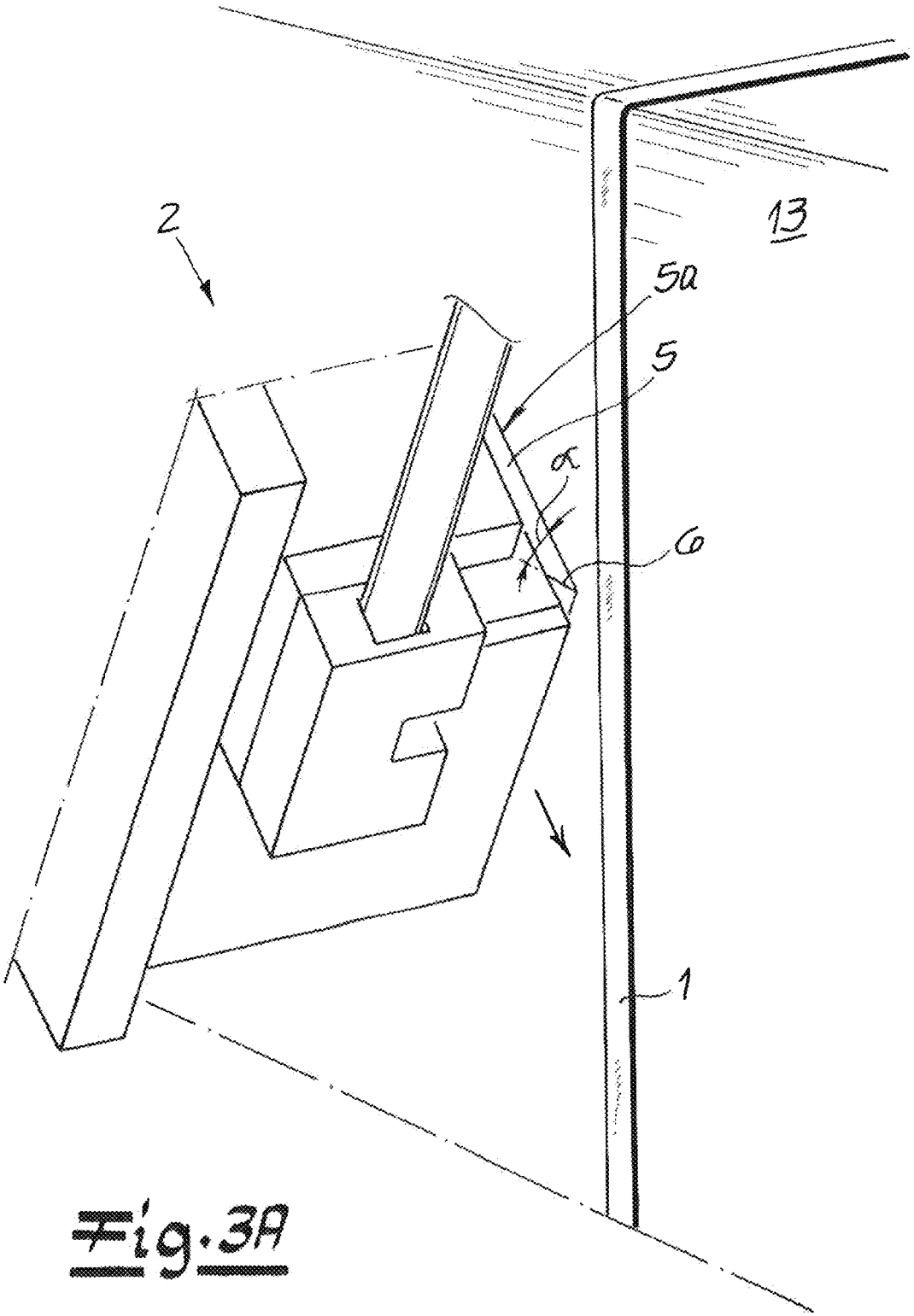
FIG. 3A to 3D are detail views of the strapping head during a cutting process.
Figure 3B:
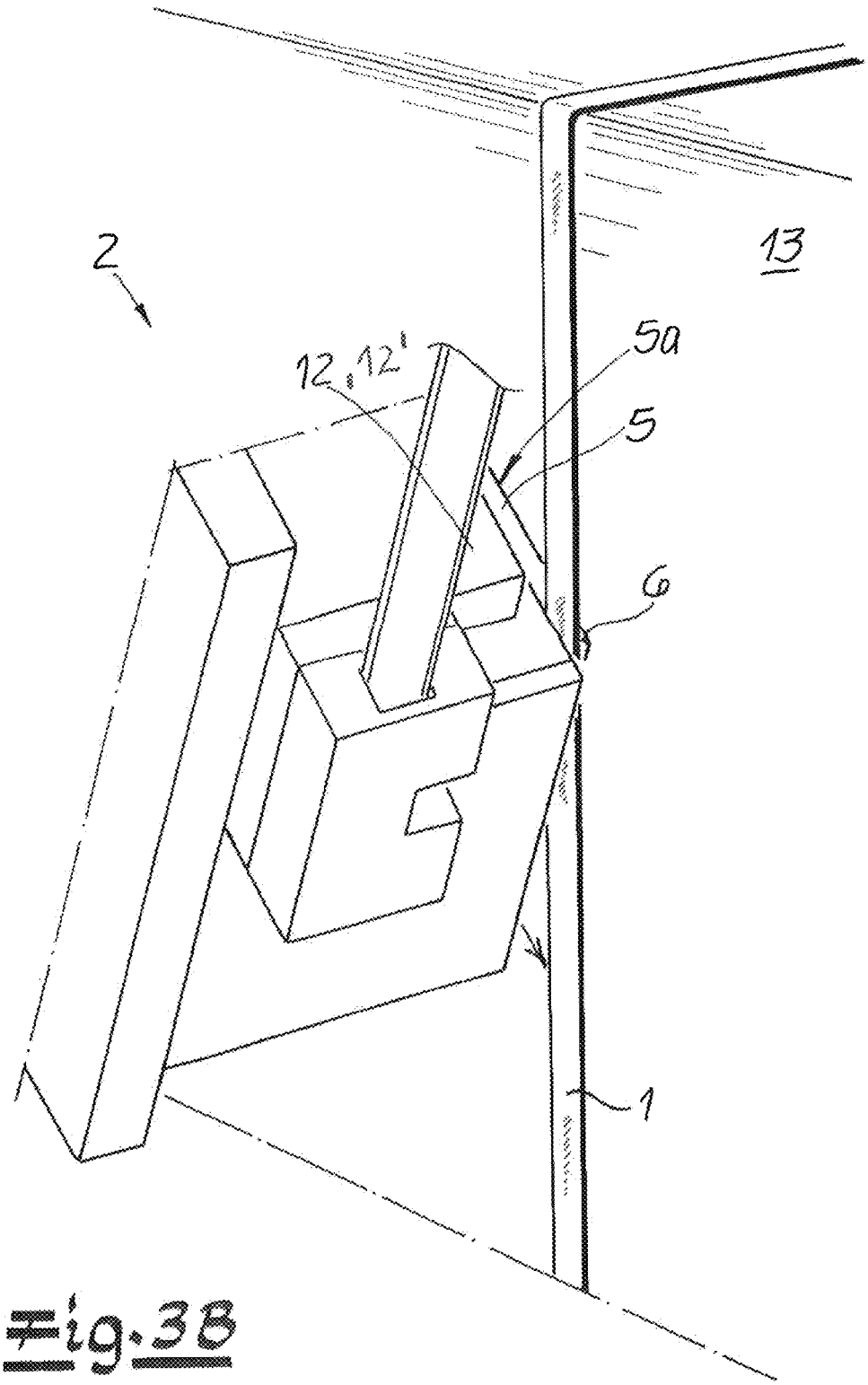
Figure 3C:
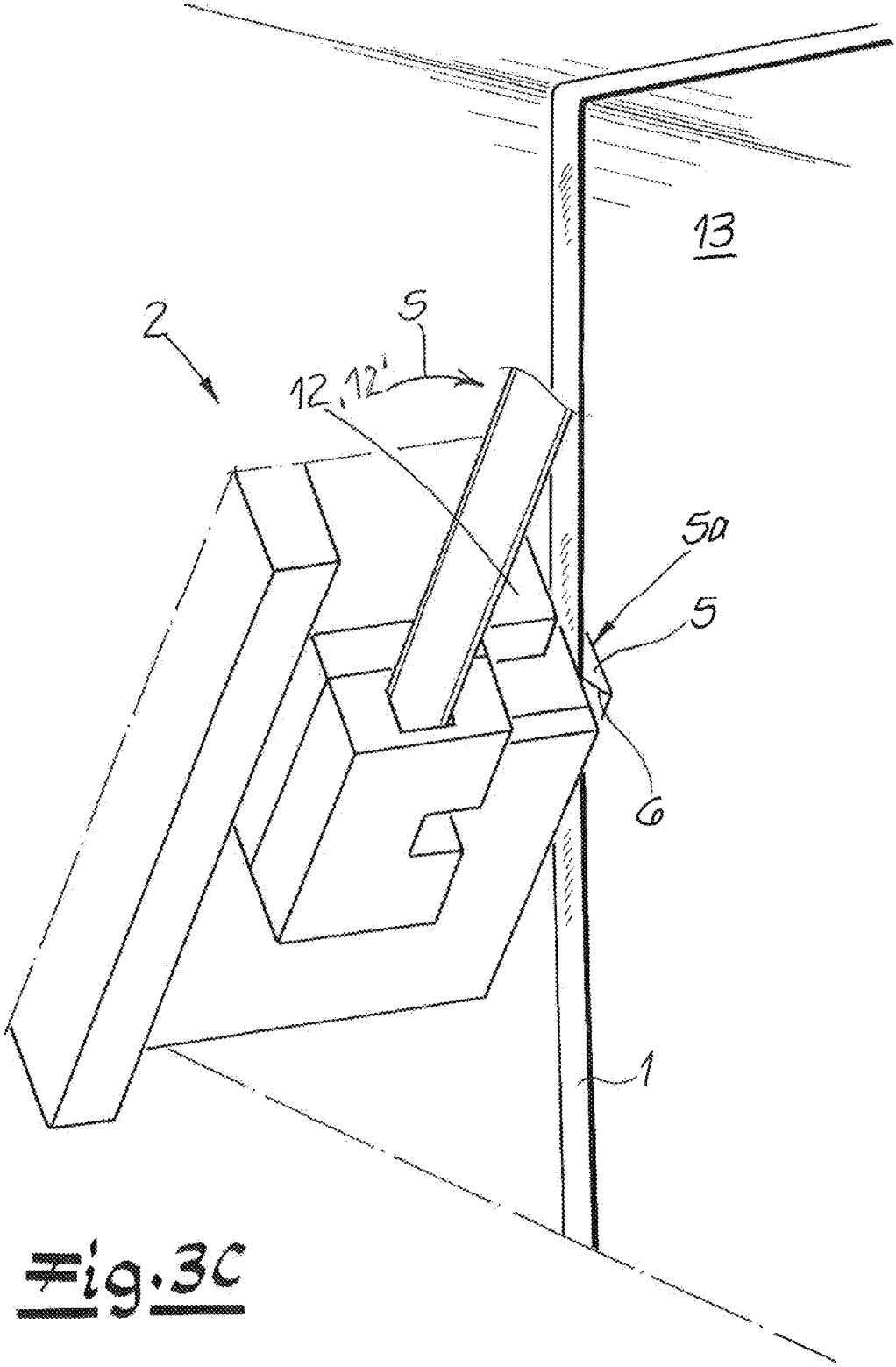
Figure 3D:
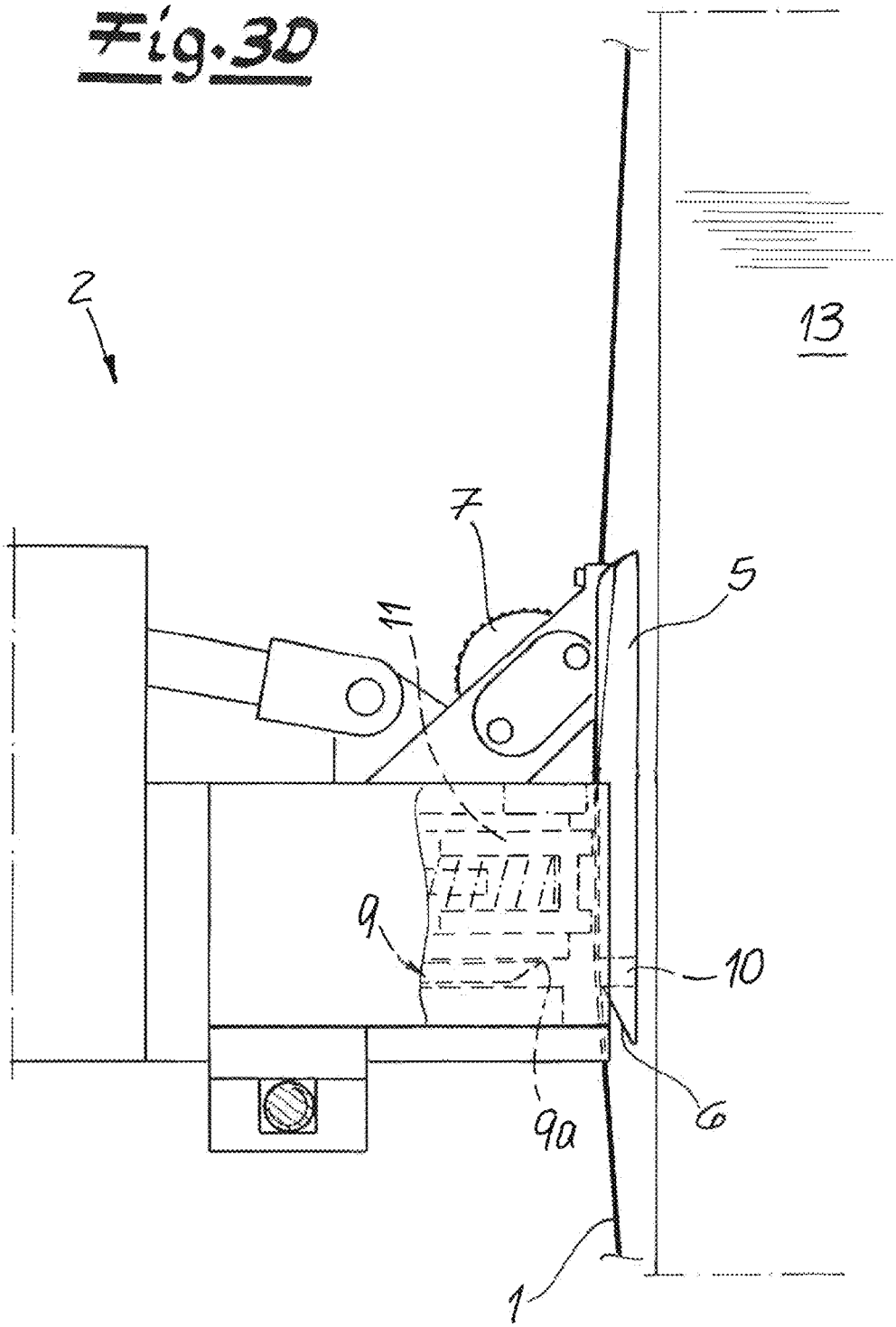

Here, as seen in FIGS. 3A and 3B, first there is the corner pushing down and slipping under the strap 1 with the aid of the full common base plate 5 then the base plate 5 and thus also the treatment head 2 being pivoted toward the strap 1 so that the full edge 5*a* passes completely under the strap as shown in FIGS. 3C and 3D. This pivoting thereby has the final effect that the treatment head 2 rotates in a wiping or swivel movement as shown by the arrow in FIG. 3C as far as the pushing movement S is concerned. During this pivoting process, the corner of the base plate 5, which has passed under the strap, acts as a pivot point, as it were. In this way, the lift edge or bevel 6 on the edge 5*a* of the base plate 5 facing the strap 1 can gradually move under the strap 1.

This has the consequence that thereby the strap 1 is lifted by the base plate 5 from the packaged goods 13. The pivoting of FIGS. 3C and 3D of the treatment head 2 or its base plate 5 toward the strap 1 and the complete movement of the strap 1 is continued until the cutting blade 9 is aligned with its foot-side cutting edge 9*a* perpendicular to the longitudinal extension of the strap 1. This process can be controlled with the aid of the sensor or optical sensor 12 that together determine the strap position of the gripped strap 1 and thus the controller 4 operates the treatment head 2 with the manipulator or robot 3. Subsequently the strap 3 is gripped by the clamp ram 11, then severed by the cutting blade 9 and finally the separated strapping 1 is conveyed from the treatment head 2 in the transport direction T by the manipulator 3 and fed to the belt shredder.

We claim:

1. A strapping apparatus for cutting a strap on a package, the apparatus comprising:

a treatment head having on a lower side a full base plate having a lift edge;

a driven transport wheel on the treatment head;

a cutting blade on the treatment head for cutting through the strap;

manipulating means carrying the treatment head for movement in three dimensions; and control means operating the manipulating means for first passing a corner of the base plate under the strap and subsequently pivoting the base plate and passing the base plate completely under the strap.

2. The apparatus according to claim 1, wherein the base plate is essentially rectangular.

3. The apparatus according to claim 1, wherein the lift edge is formed as an at least partial bevel on an edge of the base plate facing the strap.

4. The apparatus according to claim 1, wherein the treatment head has a clamping ram for gripping the strap.

5. The apparatus according to claim 1, wherein the treatment head has a counter cutting edge on the base plate effective with the cutting blade to transversely sever the strap.

6. The apparatus according to claim 1, wherein the treatment head has a sensor for band detection of the strap on the packaged goods.

7. The apparatus according to claim 6, wherein the sensor is a laser sensor.

8. The apparatus according to claim 6, wherein the sensor is connected to the control means for aligning the cutting blade in the treatment head perpendicular to a longitudinal extension of the strap in accordance with commands.

9. The apparatus according to claim 1, wherein the manipulating means is a robot having a base and an arm on the base that carries the treatment head.

10. A method of cutting a strap wrapped around a package with an apparatus having a treatment head having on a lower side a full base plate having a lift edge and a manipulator carrying the treatment head for movement in three dimensions, the method comprising the steps of:

detecting with a sensor the strap on packaged goods;

in accordance with commands stored in a controller, engaging a corner of the base plate under the strap;

thereafter pivoting the treatment head with its base plate toward the strap and passing the base plate completely under the strap until a cutting blade on the treatment head is perpendicular to a longitudinal extension of the strap;

gripping the strap with a clamping ram and then cutting the strap with the cutting blade;

thereafter retracting the clamping ram from the strap;

thereafter conveying the cut strap from the treatment head with a driven transport wheel of the treatment head while the cut strap is gripped by the manipulator; and feeding the cut strap to a shredder.

* * * * *